United States Patent [19]

Johnston

[11] Patent Number: 4,763,802

[45] Date of Patent: Aug. 16, 1988

[54] BOTTLE PUMP

[76] Inventor: Roy Johnston, 10th Floor, Richardson Building, One Lombard Place, Winnipeg, Manitoba, Canada, R3B 3H1

[21] Appl. No.: 29,574

[22] Filed: Mar. 24, 1987

[30] Foreign Application Priority Data

Mar. 25, 1986 [CA] Canada ..... 505600

[51] Int. Cl.[4] ..... B65D 51/24

[52] U.S. Cl. ..... 215/228; 53/88; 417/437; 417/554

[58] Field of Search ..... 215/228; 417/554, 437; 53/88

[56] References Cited

U.S. PATENT DOCUMENTS

| | | | |
|---|---|---|---|
| 42,429 | 8/1912 | Hutston . | |
| 53,600 | 9/1896 | Browne . | |
| 1,370,706 | 3/1921 | Price . | |
| 2,069,383 | 5/1936 | Nedbalek . | |
| 2,154,393 | 7/1935 | Bates . | |
| 2,312,067 | 6/1941 | Bates . | |
| 2,771,226 | 11/1956 | Bates . | |
| 4,372,096 | 2/1983 | Baum | 53/88 |
| 4,524,877 | 6/1985 | Saxby et al. | 215/228 |
| 4,640,426 | 2/1987 | Wasley | 215/228 |

FOREIGN PATENT DOCUMENTS

| | | |
|---|---|---|
| 924275 | 4/1973 | Canada . |
| 1172612 | 8/1984 | Canada . |

*Primary Examiner*—Donald F. Norton

*Attorney, Agent, or Firm*—Hoffman, Wasson & Fallow

[57] ABSTRACT

Carbonated beverages in bottles lose their carbonation and become flat once the bottle is opened. In this invention carbonation is preserved and maintained in a simple, inexpensive manner by re-introducing pressure into a bottle which has been opened. A small pump consisting of a cylinder, piston and threaded cap is attached to the top of an opened bottle. This hand operated pump re-introduces pressure to the bottle in the form of compressed air and thus maintains the concentration of carbon dioxide in the liquid regardless of the amount of liquid remaining in the bottle. The pump introduces an air pressure of fifty to sixty pounds per square inch to the bottle which is equivalent to the air pressure found in unopened carbonated beverage bottles at 21 degrees celsius.

5 Claims, 2 Drawing Sheets

BOTTLE PUMP

FIELD OF THE INVENTION

This invention relates to a device for maintaining carbonation in carbonated beverage containers.

BACKGROUND OF THE INVENTION

It is common, in order to partially maintain carbonation in carbonated beverages, to simply seal the bottle after opening. However, this does not maintain the near original carbonation of the liquid because it does not re-introduce pressure into the bottle to compensate for unsealing the bottle, and pressure continues to be lost each time the bottle is opened and beverage is used. Hence the original level of carbonation is not preserved in the liquid, and it becomes "flat" and unpalatable.

SUMMARY OF THE INVENTION

These disadvantages are overcome by the present invention, which provides a device for supplying air under pressure to the interior of a container for carbonated beverages to maintain carbonation therein, comprising;

i a body adapted to be secured to a container opening and to seal tightly thereto ii one way valve means in the body for sealing the body against leakage of fluid from the container iii pump means in the body upstream of the one-way valve means for supplying air, upon actuation, to the interior of the container, and iv pressure relief valve means for limiting the pressure applied to the interior of the container;

whereby, when the body is secured to a container, the pump may be actuated to increase pressure within the container to maintain pressure necessary for carbonation, the relief valve means preventing over-pressurization of the interior of the container.

BRIEF DESCRIPTION OF THE DRAWINGS

The attached drawings illustrate an embodiment of the invention.

In the drawings

DETAILED DESCRIPTION OF A PREFERRED EMBODIMENT

Figure 1:
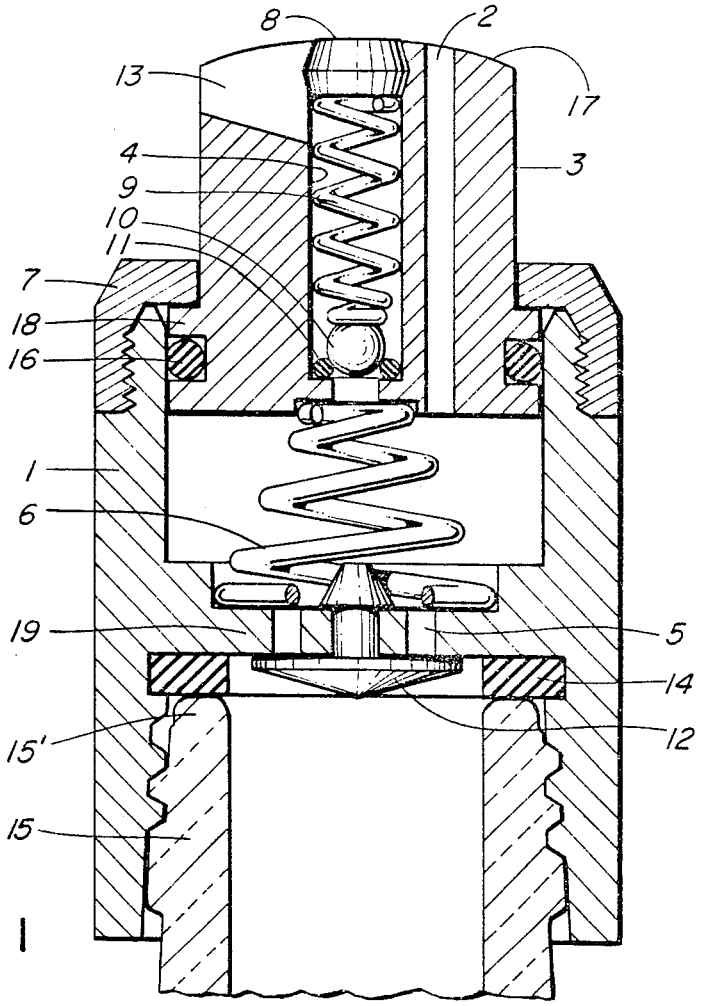
FIG. 1 is an enlarged schematic side view, in section, of one of the embodiments.

In the device illustrated, the piston 3 extends through the top of the cylinder 1 forming an external push button. Upon pressing the external push button with the palm of the hand, air pressure is created within the cylinder 1. This pressure passes into the bottle through radially arranged ports 5 in the bottom of the cylinder. A flat, rubber, one way valve 12 prevents air from exiting the bottle. Once a pressure of 50–60 pounds per square inch is achieved within the bottle a pressure relief valve 10 within the piston 3 opens, exhausting from the cylinder, to atmosphere, any compressed air in excess of 50–60 pounds per square inch.

Cylinder 1 attaches to a bottle top 15' in any suitable manner appropriate to the type of bottle. Air intake to the cylinder is via three longitudinal holes 2 extending through the piston 3. The piston 3 is sealed to the cylinder 1 by a rubber O-ring 16. Extending through the top of the cylinder 1, the piston 3 also defines an external push button 17. When this external push button 17 is pressed with the palm of the hand, air in the cylinder 1 is forced through radially arranged ports 5 in the bottom of the cylinder 1 into the bottle 15. The user's palm acts as a one way valve on push button 17, preventing air from exiting the cylinder 1 upon the compression stroke but allowing air to enter when the palm is lifted during the return stroke.

The piston 3 is returned to its original position, extending above the cylinder 1, by a return spring 6 which is disposed immediately beneath the piston 3. This return spring 6 is tapered spirally so that it lies flat when compressed, i.e., when the piston 3 is pressed downwards.

The piston retaining ring 7 is a screw-on ring which is threaded to the top of the cylinder 1 and serves to retain the piston 3 via flange 18 upon completion of the return stroke, i.e., upon being returned to rest by the return spring 6.

A flat, rubber, one way valve 12 disposed in the cylinder body prevents air in the bottle from exiting through the ports in the bottom 19 of the cylinder 1.

Figure 2:
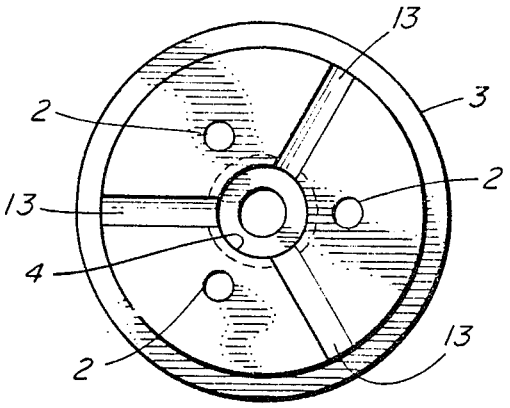
FIG. 2 is a plan view of a portion of the embodiment of FIG. 1, namely a piston.
Figure 3:
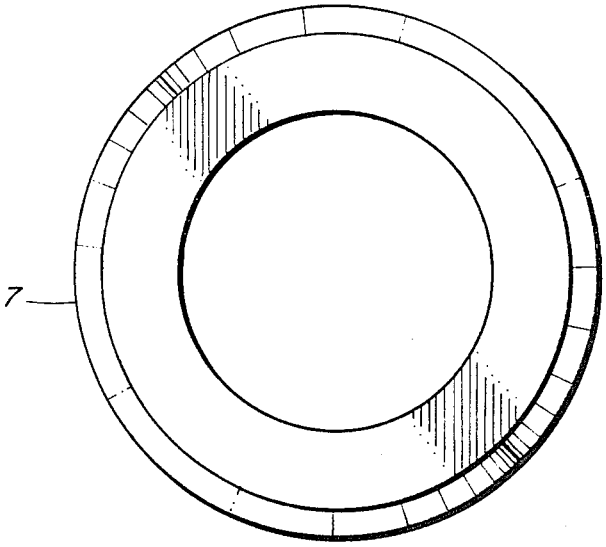
FIG. 3 is a top plan view of a portion of the embodiment of FIG. 1, namely, the piston retaining ring.
Figure 4:
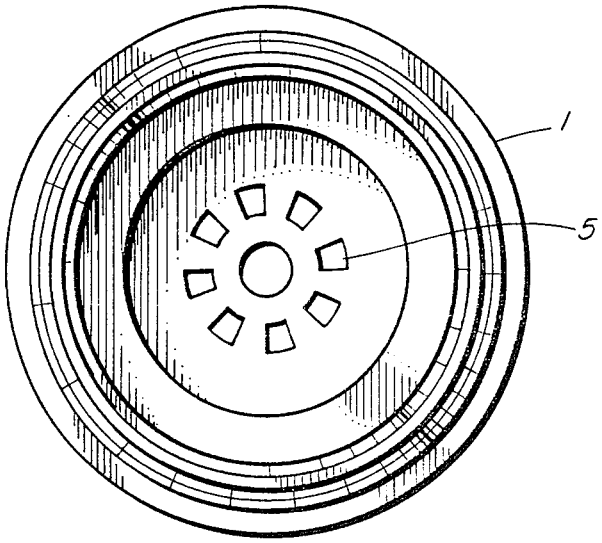
FIG. 4 is a plan view of a portion of the embodiment of FIG. 1, namely the cylinder.

In use the external push button 17 is repeatedly compressed, using the palm of the hand to close holes 2 until an air pressure of from fifty to sixty pounds per square inch is achieved within the bottle. A pressure relief valve 10 within the piston exhausts to the atmosphere any air compressed within the cylinder in excess of the desired safety limit of fifty to sixty pounds per square inch. This one way valve assembly consists of a spring 9 and ball 10 seating on rubber O-ring 11. The O-ring 11 creates a seal around the ball 10. When the desired pressure within the cylinder 1 is reached, the ball valve 10 is pressed upward, off its O-ring valve seat 11, overcoming the preset pressure of the spring 9, and air is exhausted into the pressure relief port 4. However the palm of the user prevents air from exiting the top of the piston, as does the press-in plug 8 at the top of the pressure relief port 4 which serves to retain the pressure relief valve spring 9. To overcome this problem, three radially arranged deep slots 13 (FIG. 2) are cut from the pressure relief port 4, horizontally through the piston 3. The relief port slots 13 remain above the top of the piston retaining ring 7, through all piston positions, to ensure positive exhaust of over pressure.

Between the bottle top and the bottom of the cylinder is a round, flat rubber ring 14 acting as a seal.

What I claim as my invention is:

1. A device for supplying air under pressure to the interior of a container for carbonated beverages to maintain carbonation therein, comprising:

i. a body defining a cylinder and adapted to be secured to a container opening and to seal tightly thereto;

ii. one way valve means in the body for sealing the body against leakage of fluid from the container, said one way valve means being disposed between the cylinder and a downstream position of the body;

iii. pump means in said body upstream of the one-way valve means for supplying air, upon actuation, to the interior of the container, said pump means comprising a piston biased outwardly of said cylinder by spring means captively disposed therein;

iv. pressure relief valve means for limiting the pressure applied to the interior of the container; and v. at least one through intake port in the piston adapted to be sealed by the palm of the hand of the user to seal the piston on its compression stroke;

whereby when the body is secured to the container, the piston may be actuated to create pressure in the cylinder, which pressure is communicated through the one-way valve means to increase pressure within the container to maintain pressure necessary for carbonation, the relief valve means preventing over-pressurization of the interior of the container.

2. A device as claimed in claim 1 wherein the pressure relief valve means is disposed in the piston, and is biased to its closed position by a spring and is set to open when pressure in the cylinder exceeds a predetermined level, so that pressure in the container cannot exceed a safe level.

3. a device as claimed in claim 1 wherein the body comprises a cylindrical element having two opposite cavities, one cavity comprising means for securing the body to a container and the second cavity defining said cylinder and a transverse web between the cavities, the web supporting the one way valve means.

4. A device as claimed in claim 2 in which said relief valve means is located on the longitudinal axis of said piston.

5. A device as claimed in claim 1 in which at least one pressure relief channel is located radially in the outer end of said piston, in communication with said pressure relief valve means.

* * * * *